United States Patent [19]

Franklin et al.

[11] Patent Number: 4,877,172

[45] Date of Patent: Oct. 31, 1989

[54] DISPENSING OF ATTACHMENTS

[75] Inventors: Harlow Franklin, Randolph, Mass.; William J. Cooper, Woonsocket, R.I.; Charles L. Deschenes, No. Attleboro, Mass.

[73] Assignee: Dennison Manufacturing Company, Framingham, Mass.

[21] Appl. No.: 239,695

[22] Filed: Sep. 2, 1988

[51] Int. Cl.[4] ..... A41H 37/00

[52] U.S. Cl. ..... 227/67; 227/76; 227/114

[58] Field of Search ..... 227/19, 67, 73, 76, 227/99, 111, 114, 116, 135, 136

[56] References Cited

U.S. PATENT DOCUMENTS

| | | | |
|---|---|---|---|
| 3,650,453 | 3/1972 | Smith, Jr. | 227/136 X |
| 4,111,347 | 9/1978 | Bone | 227/97 X |
| 4,456,161 | 6/1984 | Russell | 227/67 |
| 4,588,121 | 5/1986 | Olesen | 227/136 X |

*Primary Examiner*—Douglas D. Watts
*Assistant Examiner*—James L. Wolfe
*Attorney, Agent, or Firm*—Arthur B. Moore

[57] ABSTRACT

Method and apparatus for dispensing of attachments comprising a pair of side members linked by a connector. A roll of fastener stock is fed to a reciprocatively driven slide head assembly at which the roll is advanced over an elastomeric feed belt to a pair of needles secured to a shuttle. Once inserted in the needles, an individual attachment is severed from the stock, and displaced over a preset distance by the shuttle into the path of a pair of ejector rods. The ejector rods force the side members of the attachment out of the needles for insertion in a fabric or other workpiece at the bottom of the head stroke. On return stroke of the head, the needles are withdrawn, ejector rods retreat, and the shuttle returns to its severing position in a manner to avoid mechanical interference. This design uses an electric motor driven fastener dispensing head, actuator slide and associated linkages for actuating the various mechanisms either on an on-demand or continuous basis. Reliability is improved by severing the attachment stock in the needle, and transferring the severed attachment to its insertion location.

18 Claims, 5 Drawing Sheets

FIG. 4
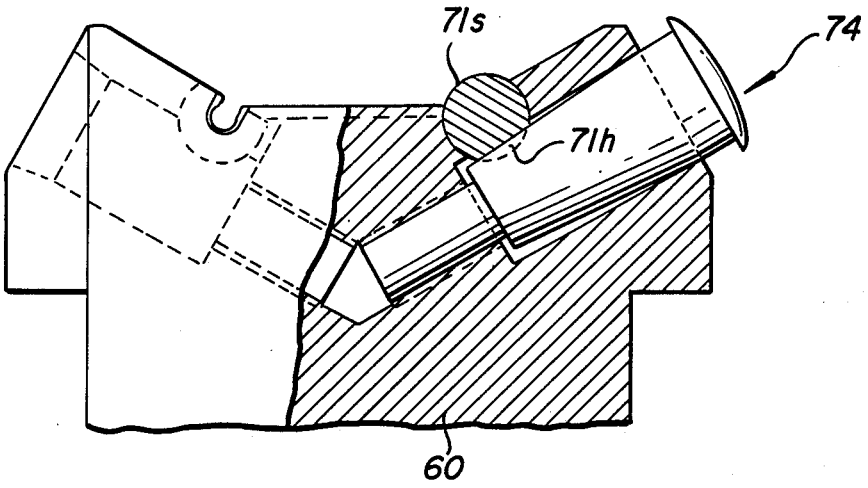
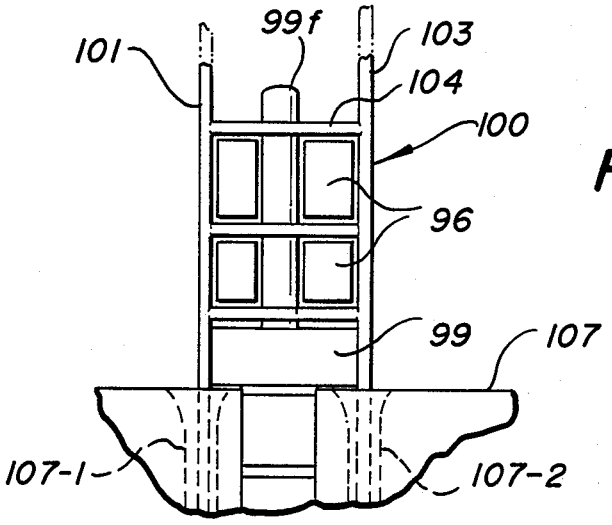
FIG. 5

DISPENSING OF ATTACHMENTS

The invention relates to the dispensing of attachments and more particularly to the dispensing of attachments from continuous ladder stock.

One type of device for the dispensing of attachments is disclosed in U.S. Pat. Nos. 4,039,078 of Aug. 2, 1977; 4,121,487 of Oct. 24, 1978; 4,111,347 of Sept. 5, 1978 and 4,179,063 of Dec. 18, 1979. In these patents the attachments are included in continuously connected stock formed by two elongated and continuous plastic side members coupled by a plurality of plastic cross links, which preferably are equidistantly spaced apart.

The stock may be produced from flexible plastics material including nylon, polypropylene and other materials by molding or by stamping. Illustrative techniques for producing the stock are disclosed in U.S. Pat. Nos. 4,039,078, 4,121,487, 4,111,347 and 4,179,063.

Such attachments can be dispensed to couple buttons to fabric, merchandising tags to articles of commerce, and in the general attachment of one item to another. In particular, in the case of dispensing devices with dual needles ladder stock fasteners as described above can be dispensed. The assignee sells such fastener stock under its PLASTIC STAPLE trademark.

Commonly assigned U.S. Pat. No. 4,533,076 discloses apparatus for dispensing attachments of the type described above, wherein attachments fed from a continuous roll are severed into individual attachments, and the severed attachments displaced by a slide into engagement by ejection from at least one needle. This system has performed reasonably well in the dispensing of plastic attachments, but has shortcomings in its reliance on pneumatic actuation, the need to transfer the severed attachments into the slide, and certain other aspects.

Accordingly, it is a principal object of the invention to increase the reliability and utility of devices used in the dispensing of attachments, especially attachments consisting of two side members coupled by a cross link. It is particularly desired to provide devices for this purpose which are inexpensive in construction, require a minimum of adjustments, have a broad tolerance range, minimum critical dimensions and which are also adaptable to a variety of applications including dispensing attachments to couple delicate objects such as fine fabrics and the like.

SUMMARY OF THE INVENTION

In accomplishing the above and related objects, the invention provides for the feed of continuously connected stock, desirably of plastics material, to at least one slotted hollow needle housed in a shuttle at a first position where an individual attachment is isolated from the stock. This preferably is achieved by severing an individual attachment from the stock, but it may also be achieved by isolating a pre-severed attachment from the remainder of the stock. The shuttle then moves with at least one needle and individual attachment to a second position at which the attachment is dispensed.

In accordance with one aspect of the invention, the individual attachments are fed to the shuttle by a continuous feed belt. The feed belt is rotatably driven to advance the attachment stock toward the first position of the shuttle. The feed belt includes a plurality of projecting members which engage rungs of the stock to achieve the desired positioning of the stock. Preferably, an advancement mechanism in operative relationship to the feed belt indexes the belt to advance the attachment stock at the end of each attachment dispensing cycle. Also preferably, a sled member prevents entanglement of the fastener stock when exiting the feed belt.

In accordance with another aspect of the invention, the shuttle is slideably mounted to move between the first and second positions, and adjustable stop means are provided to ensure that the shuttle is correctly aligned with the plunger and other mechanisms at said first and second positions. Desirably, means are provided for adjusting the vertical position of the ejector rods to accommodate timing tolerances relative to the needles.

In accordance with a further aspect of the invention, the preparation and dispensing of the attachments includes the steps of feeding the attachments to a shuttle at a first position thereof and forming an individual attachment, desirably by severing. In the next step, the shuttle is moved to a second position in alignment with a plunger so that the attachment which it contains can be expelled by the plunger through at least one hollow needle. The plunger is thereafter retracted until it clears the shuttle, which is then positioned to receive the next individual attachment. The shuttle is reciprocated between the first and second positions for dispensing of successive attachments.

Where the attachment stock is in the form of a attachment, one end is expelled through a first needle and the other end is simultaneously expelled through a second needle.

In accordance with still another aspect of the invention, each individual attachment is separated from the connected plurality (stock) by a blade which is slideably mounted to move transversely with respect to the plurality. The blade is desirably controlled by the same means which actuates the expulsion and advancing mechanisms.

In accordance with still another aspect of the invention the operations of the machine are controlled and driven by an actuator slide. The actuator slide has a plurality of cam surfaces to actuate the knife (attachment severing device), shuttle and plungers. Advantageously, the actuator slide incorporates fixed and movable racks, which cooperate with a gear assembly to precisely control the motion of the fastener dispensing head. Preferably, various actuating arms control the blade mechanism, the shuttle positioning mechanism, the expulsion mechanism and the advancing mechanism, said arms desirably being controlled by cams.

In accordance with yet another aspect of the invention, attachment expulsion takes place through at least one slotted hollow needle. Advantageously, a scallop or hollow region of the needle mates with a tapered screw to properly position the needle and lock it in place.

In accordance with another aspect of the invention, the attachment dispensing system may operate on demand to dispense a single attachment, or alternatively may operate continuously to dispense a plurality of attachments over successive cycles. Most preferably, the drive source for the system is comprised of an electric motor, which may operate in conjunction with a clutch mechanism for on-demand performance.

BRIEF DESCRIPTION OF THE DRAWINGS

Other aspects of the invention will become apparent in considering the following detailed description of the preferred embodiment of the invention, to be taken in conjunction with the drawings in which:

FIG. 4 is a partial sectional view of the needle end of the shuttle, showing on one side engagement of a needle with a needle locking screw;

FIG. 5 is a partial elevational view of the exit area of the feed belt showing the sled.

DETAILED DESCRIPTION

Figure 3:
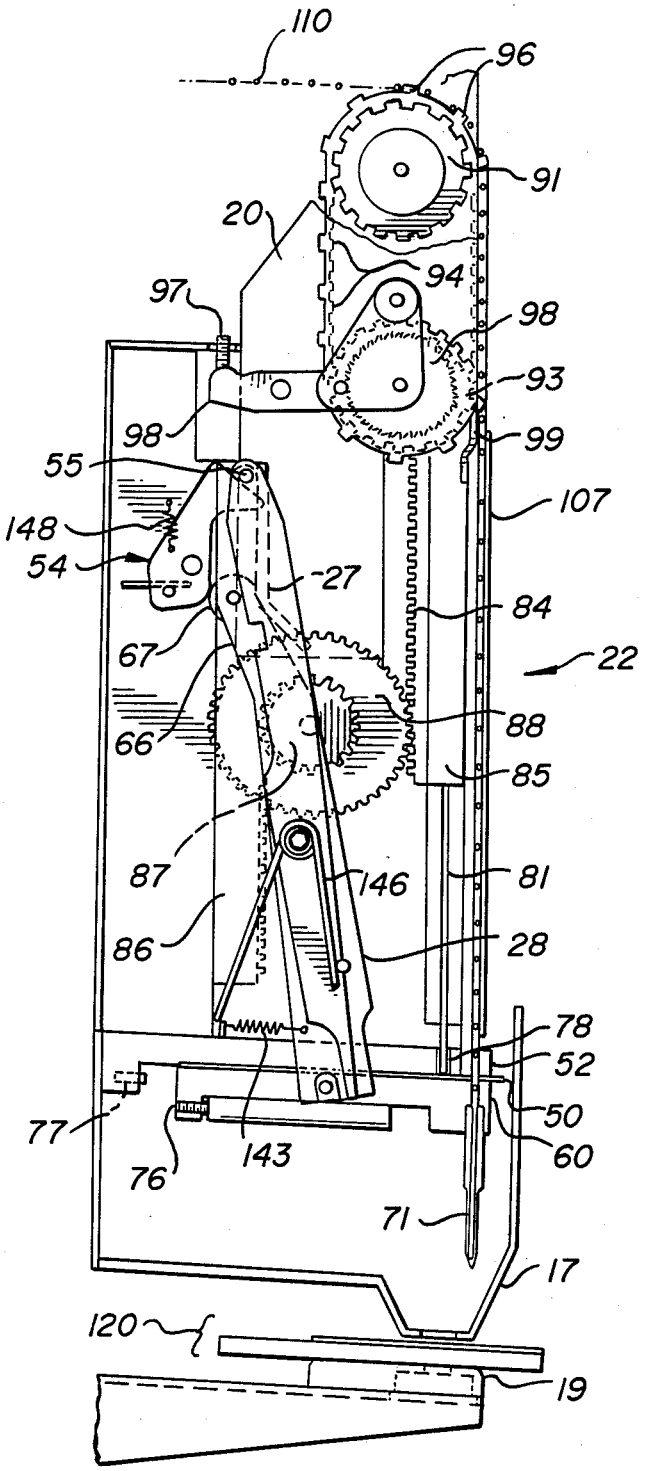
FIG. 3 is a side elevation view showing the actuator slide, head, and principle fastener dispensing mechanisms of the apparatus of FIG. 1.
Figure 6:
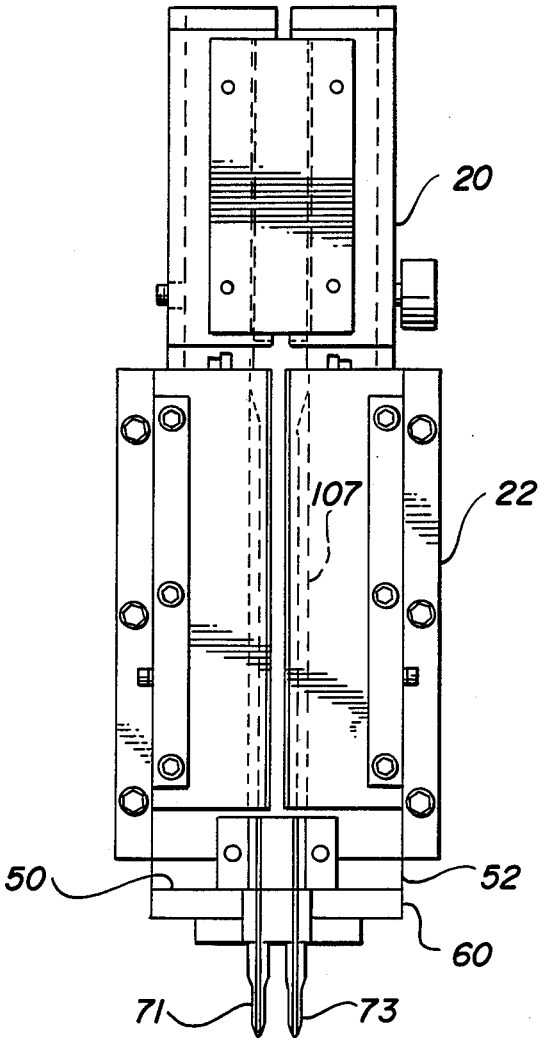
FIG. 6 is a front elevation view of the apparatus of FIG. 3.

Reference should now be had to FIGS. 3 and 6 for an overview of a dispensing and attaching device 10 in accordance with a preferred embodiment of the invention. Device 10 is used to form individual fasteners 100 from fastener stock 110, and to dispense and attach the individual fasteners 100 to workpieces 120 as described below. The following described device is intended for attachment using fasteners consisting of two plastic side members coupled by a plastic crosslink, and as partially illustrated in FIG. 6 and described below includes duplicates of various mechanisms (needles 71 and 73, etc.) However, the invention also encompasses dispensing and attaching apparatus for other types of fasteners wherein only a single set of such mechanisms is provided.

Figure 2A:
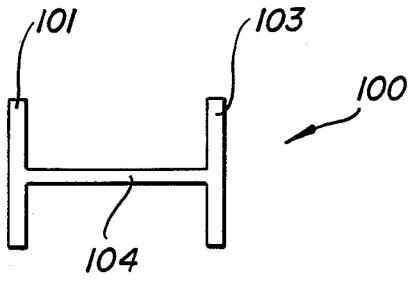
FIG. 2A is a plan view of a preferred type of attachment to be applied by the device of FIG. 1.
Figure 2B:
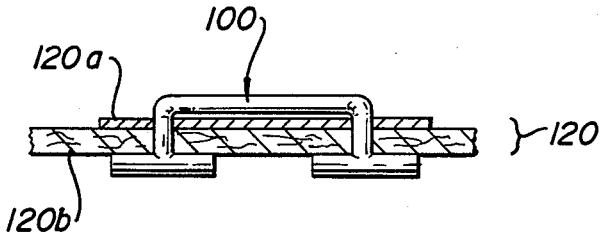
FIG. 2B is a sectional view of the illustrative fastener of FIG. 2A after it has been inserted through two materials to fasten them together.

FIG. 2A illustrates an individual flexible attachment 100 consisting of side members or cross bars 101 and 103 and connection 104. An individual attachment is severed from a continuous roll of stock 110 as disclosed, for example in commonly assigned U.S. Pat. No. 4,533,076. FIG. 2B shows a attachment 100 attached to a workpiece 120 (e.g. a tag 120*a* and garment 120*b*) after being expelled through dual needles which have penetrated the workpiece. During the expulsion the cross bars 101 and 103 of the attachment are pushed through respective bores of the needles 71 and 73, and the connector 104 forms an arc from the slot of needle 71 to the slot of adjacent needle 73. As the cross bars are expelled and the needles are withdrawn, the cross bars configure themselves on the reverse side of the workpiece 120 as shown in FIG. 2B.

FIG. 3 gives a partial cross sectional view of a fastener dispensing head 22 which houses the mechanisms for receiving and routing the fastener stock 110, severing individual fasteners 100 from the stock while the cross bars 101 and 103 are retained in a pair of hollow slotted needles (one of which is seen 71), moving the needles to a fastener dispensing location, and ejecting the fastener cross bars 101 and 103 (FIG. 2A) to dispense the fastener 100 (e.g. for use as an attachment as shown in FIG. 2B). Major elements of the head 22 include an actuator slide 20 and associated linkages which drive the various mechanisms in synchronism as discussed below; a novel elastomeric feed belt (or drive belt) 90 which routes and advances the fastener stock 110 to the area where individual fasteners are severed therefrom; a novel, reciprocatively mounted shuttle 60 which fixedly carries the needles (one of which is seen at 71 in this view) and moves between fastener severing and fastener dispensing locations; a knife 50 (supported by knife block 52) which severs a fastener 10 from the fastener stock 110; and a pair of ejector rods (one of which is seen at 81 in this view) which push the respective fastener cross bars 101 and 103 out of the needles.

The actuator slide 20 is driven down over the fixed fastener dispensing head 22 by a pair of racks and gear assembly (as described below), and by means of cam-cam follower assemblies, stop members, and driving springs drives various mechanisms and performs the fastener dispensing operation in a sequence described below. The actuator slide 20 carries cam follower rollers 55, 67 which are driven over respective cams 54, 27 in order to actuate the shuttle 60 and knife 50, as described below. Slide 20 also drives two ejector rods (only one of which is seen in this view) to insert the fastener through the needle into workpiece 120.

Two feed belt sprockets 91,93 and a fed belt or drive belt 90 operate in conjunction to receive fastener stock 110 fed from supply spindle 19 (FIG. 1) and to guide and advance this fastener stock to the shuttle-needle assembly. The feed belt has standard teeth 94 on its inner surface to mate with the sprockets, and special teeth 96 on its outer surface suitably configured to accommodate and drive the fastener stock 110. Advantageously, as seen in FIG. 5, teeth 96 are spaced apart in pairs and allow a finger projection 99*f* of a sled 99 to ride on the outer surface of belt 90 to prevent the fastener stock 110 from wrapping around belt 90 and to route the stock into channels 107-1 and 107-2 of feed guide 107. As shown in FIG. 3, sled 99 may be mounted to feed guide 107. In the preferred construction, belt 90 is made from Kevlar thread in the long direction of the belt, to prevent it from stretching beyond its required pitch. Cotton thread can be used in the transverse direction. Timing belt sprockets 91, 93 are driven by a ratchet assembly 98 (advantageously, as discussed below at paragraph 12 of the operation sequence description, actuated by a spring pin feed adjustable screw 97). A knob (not shown) may be provided to allow loading the staple chain 110 simply by advancing the feed belt. Although the preferred design of feed belt 90 consists of a continuous elastomeric belt, the invention encompasses other designs such as articulated metal belts.

The head support 18 (FIG. 1) mounts the head 22 which comprises a substantially rectangular structure with three sides. Head 22 supports the various mechanisms and drive elements seen in FIG. 3. The head support mounting for head assembly 22 is a slide to allow the head to freely reciprocate in the expulsion and withdrawal directions.

The rack and gear assembly, which comprises stationary rack 86 and movable rack 84 drivingly connected by a gear assembly, includes a first gear 87 engaged with the stationary rack 86 and a second gear 88 of greater diameter engaged with the movable rack 84. The gears 87 and 88 are fixed to each other and rotatably mounted to move with the slide assembly. As the slide assembly 29 moves in the expulsion direction, the rotation of the smaller gear 87 in interaction with the stationary rack 86 turns the larger gear 88 thus driving the movable rack 84 in the expulsion direction, causing the ejector rod 81 connected to the movable rack slide 85 to move through the plunger clearance region 78 in knife block 52, eventually passing into the dispensing needle. The rear position of the shuttle 60 is adjusted by stop screw 77 to align the needle with the plunger clearance region 78. It will again be appreciated that FIG. 3 merely represents one side of the head assembly 22: there is a plunger or ejector rod on the other side of the device when the device is used with two needles 71, 73.

The knife actuating arm 28 is desirably controlled by cam 54, the arms being pivotally connected to the slide assembly 20 to move therewith. Initial movement of the head 22 in the expulsion direction drives a roller 55 mounted on the end of the arm over the cam 54. The cam is disposed at an angle which causes the arm to pivot, urging in the severing direction the blade 50, which is connected pivotally to the other end of the arms. The arms are desirably spring-loaded so that the blade is retracted immediately after severing. It will be appreciated that FIG. 3 merely represents one side of the head assembly; duplicates of arm 28 and cam 54 are not seen in FIG. 3.

Shuttle actuating arms (only one is shown at 66 in FIG. 3) are connected pivotally at one end to the shuttle and extend away from the shuttle expulsion direction, with a roller 67 mounted at other end of the arm. A spring 143 is desirably attached to shuttle arm 66 to bias the shuttle toward the dispensing position. A cam 27 defines a cam surface including an upper, dwell region and a lower region disposed at an angle away from the dispensing direction. When the cam roller 67 is seated in the dwell region of the cam 77, shuttle 60 is located in its loading position. The actuating arm roller 67 travels to the outermost portion of the cam profile 27 as the head 22 travels in the expulsion direction, shuttle 60 then being urged to the dispensing position by the bias applied by the spring 143. Set screws 76 and 77 permit the operator to adjust the forward and rear stop positions, respectively, of the shuttle 60. A mounting screw (not shown) permits operator adjustment of the eject rods 81, 83 along their axes. Also advantageously, as seen in FIG. 12, a tapered screw 84 is inserted to snugly engage a hollow **71*h* in needle shank 71*s* thereby to properly position the needle and lock it in place (a locking screw, not shown in this view, is also provided for needle 73**).

Figure 1:
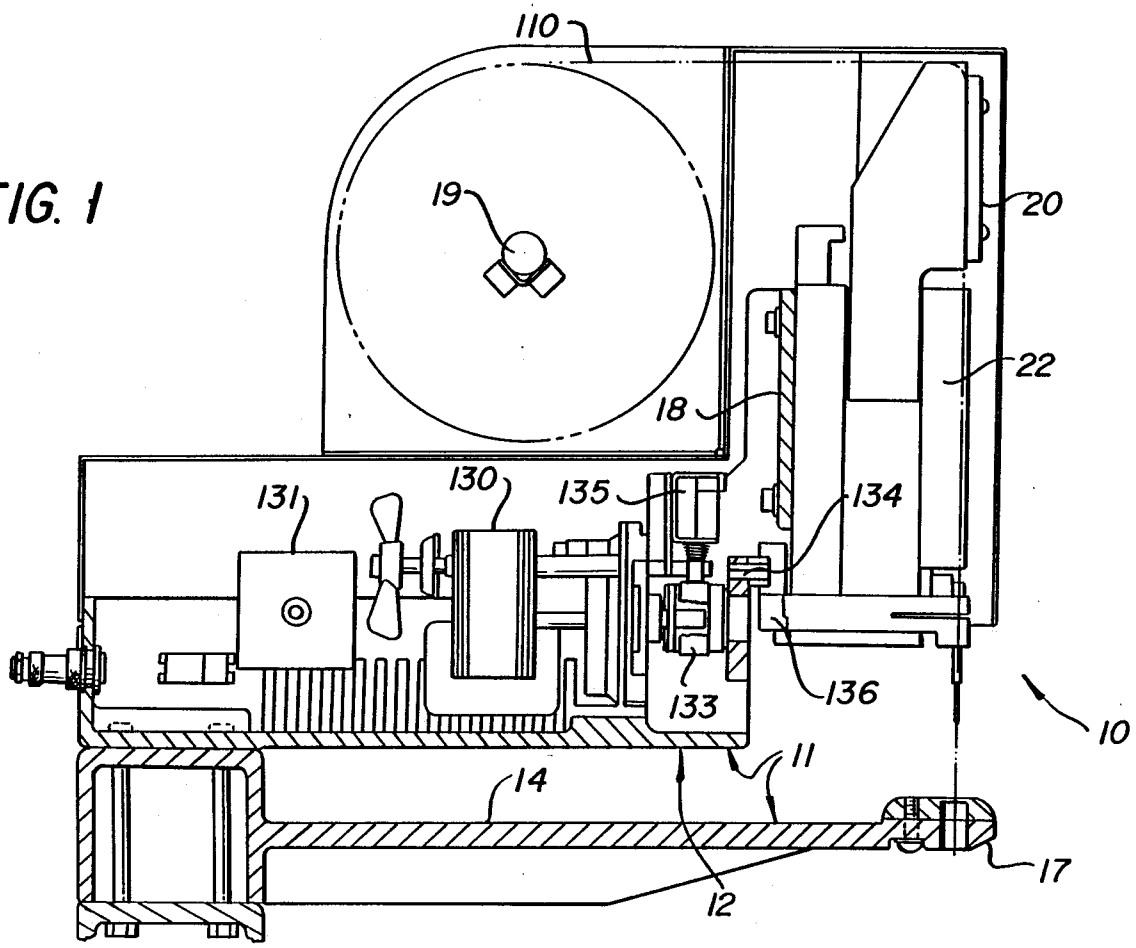
FIG. 1 is a partial cross-sectional view of the apparatus of the invention showing details of its superstructure and its drive train.

Reference should now be made to FIG. 1 for an illustration of drive elements for the head assembly 22 of fastener dispensing apparatus 10. The apparatus 10 includes a frame 11 of modular construction allowing for adaptation to various applications. The principal parts of the frame include the base 12, the reactor plate arm 14, and the head support 18. The device 10 also includes housing side walls and a cover. The cover is connected to the side wall by a hinge (not shown) to facilitate loading of a roll of fastener stock 110 on the spindle 19.

The device 10 is illustratively powered from an electric drive motor 130 connected to a spring clutch 133 which includes a solenoid 135 for intermittent engagement of the clutch. Clutch 133 (illustratively, a wrap spring clutch) includes an input collar which is always engaged with the continuously moving shaft of motor 130. The solenoid is actuated by a "one-shot" circuit 131 of known design in conjunction with a triggering switch (not shown). The triggering switch may be foot operated, or other operator triggering adaptations could be employed. Mounted to the clutch 133 is a drive pin assembly or crank 134 engaged with a yoke 136 assembly attached to the shuttle/head. Clutch actuation allows for one full revolution of the crank, which reciprocates the shuttle/head in the expulsion direction, and then in the withdrawal direction for a complete dispensing cycle.

The operational sequence of apparatus 10, commencing in the rest position shown in FIG. 3, is as follows:

Solenoid 135 is actuated causing the output collar of clutch 133 to engage the clutch input collar for one full rotation. This causes the crank 134 to turn from top dead center clockwise. This in turn causes the yoke 136 and head assembly 22 to slide downward. This movement causes knife actuation via two spring loaded rotating cams (one seen at 54 in FIG. 3, with associated spring 148). A critical aspect of applicants' system contributing to its reliability and other performance advantages is that an individual fastener 100 is not cut from stock 110 until after it is fed into the shuttle 60. The shuttle cam 27 then causes the shuttle/needles assembly 60 to move back bringing the staple into the path of the oncoming ejector rods. The ejector rod assembly 85 in accelerated downward motion within the head assembly 22 overtakes the corresponding downward moving position of the shuttle and head assembly causing the ejector rods to force the staple's "T" ends 101, 103 down through and out of the needles. At this point in the cycle the head assembly is at the bottom of the stroke and the needles have penetrated the fabric and ticket 120 to be attached because they are supported by reactor arm 19. The reactor arms and guard plate 17 have clearance holes for the needles to pass through the plane of the fabric/ticket assembly. The crank 134 continues to turn causing the head to begin to move upward. The needles are stripped out of the fabric/ticket attachment assembly by the under side of the safety guard 17. The ejector rods retreat faster than the head assembly 22. Once clear of the ejector rods the shuttle 60 returns to its forward position to receive the next staple in the chain. Note that the knife 50 is not actuated when the head assembly rises because the spring loading of cam 54 (and its companion cam) allows it to deflect out of the path of cam follower 55 at this stage of the cycle. When the head assembly 22 reaches the top of its stroke the feed ratchet 98 contacts the spring pin feed adjustable screw 97 causing the attachment stock 110 to advance the length of one attachment into the shuttle/needles assembly 60. The solenoid 135 obstructs the rotation of the clutch collar 133 as it completes one revolution causing its disengagement and machine stop.

Although the above sequence has described the preferred, on-demand embodiment, the invention may also be applied to a continuously operating fastener dispensing system.

We claim:

1. Apparatus for dispensing attachments, comprising at least one hollow slotted needle;

shuttle means to which said hollow needle is secured, reciprocatively mounted to move between a first position and a second position;

means for advancing a connected plurality of attachments to said needle while said shuttle is at said first position;

isolating means for causing an individual attachment in said needle to be isolated from said connected plurality while said attachment is housed in the needles; and means for expelling the individual attachment from said needle while said shuttle means is located at said second position, wherein the shuttle, advancing means, isolating means, and ejecting means are mounted to a head member which moves between an attachment dispensing position and a withdrawn position, further comprising an electric motor driven assembly for reciprocating the head member including a clutch means for coupling said electric motor to said head means in response to a user command.

2. Apparatus for dispensing attachments, comprising at least one hollow slotted needle;

shuttle means to which was hollow needle is secured, reciprocatively mounted to move between a first position and a second position;

means for advancing a connected plurality of attachments to said needle while said shuttle is at said first position;

isolating means for causing an individual attachment in said needle to be isolated from said connected plurality while said attachment is housed in the needles; and means for expelling the individual attachment from said needle which said shuttle means is located at said second position, wherein the shuttle, advancing means, isolating means, and ejecting means are mounted to a head member which moves between an attachment dispensing position and a withdrawn position, further comprising an electric motor driven assembly for continuously reciprocating the head member.

3. Apparatus for dispensing attachments, comprising at least one hollow slotted needle;

shuttle means to which said hollow needle is secured, reciprocatively mounted to move between a first position and a second position;

means for advancing a connected plurality of attachments to said needle while said shuttle is at said first position;

isolating means for causing an individual attachment in said needle to be isolated from said connected plurality while said attachment is housed in the needles;

means for expelling the individual attachment from said needle while said shuttle means is located at said second position; and first and second stop members for defining said first and second positions.

4. Apparatus for dispensing attachments, comprising at least one hollow slotted needle;

shuttle means to which said hollow needle is secured, reciprocatively mounted to move between a first position and a second position;

means for advancing a connected plurality of attachments to said needle while said shuttle is at said first position;

isolating means for causing an individual attachment in said needle to be isolated from said connected plurality while said attachment is housed in the needles; and means for expelling the individual attachment from said needle while said shuttle means is located at said second position, wherein the axis of motion of said shuttle means is essentially perpendicular to the axis of said hollow needle.

5. Apparatus as described in claim 4 wherein said isolating means comprises means for severing the attachment from the connected plurality.

6. Apparatus as described in claim 4, wherein said attachment comprises a pair of side members coupled by a connector, and wherein respective slotted needles and ejecting means are provided for each side member.

7. Apparatus as defined in claim 4, wherein said advancing means includes a continuous feed belt with a plurality of projecting members.

8. Apparatus as defined in claim 7 wherein the feed belt is comprised of an elastomeric material.

9. Apparatus for dispensing attachments, comprising at least one hollow slotted needle;

shuttle means to which said hollow needle is secured, reciprocatively mounted to move between a first position and a second position;

means for advancing a connected plurality of attachments to said needle while said shuttle is at said first position;

isolating means for causing an individual attachment in said needle to be isolated from said connected plurality while said attachment is housed in the needles; and means for expelling the individual attachment from said needle while said shuttle means is located at said second position, wherein said hollow slotted needles includes a shank portion having a hollow indentation, and wherein said shuttle means includes a passage transverse to the axis of said needle, further comprising a tapered screw insertable in said passage which engages the indentation of the needle to position and lock the needle in place.

10. Apparatus for dispensing attachments, comprising a pair of hollow slotted needles;

shuttle means to which said hollow slotted needles are secured, reciprocatively mounted to move between a first position and a second position;

means for advancing a connected plurality of attachments to said needles while said shuttle is at said first position and for driving the attachments into the needles, wherein each attachment comprises a pair of side members coupled by a connector, and the respective slotted needles receive respective side members of said attachment;

means for severing an individual attachment from said connected plurality while said attachment is housed in the needles; and means for expelling the individual attachment from said needle while said shuttle means is located at said second position.

11. Apparatus as defined in claim 10 wherein the shuttle, advancing means, isolating means, and ejecting means are mounted to a head member which moves between an attachment dispensing position and a withdrawn position.

12. Apparatus as defined in claim 11, further comprising an actuating slide reciprocably mounted to the head assembly.

13. Apparatus as defined in claim 12, further comprising a rack and pinion linkage for reciprocating the actuating slide.

14. Apparatus as defined in claim 12 wherein the isolating means and expelling means are actuated by said actuating slides.

15. Apparatus as defined in claim 11, further comprising an electric motor driven assembly for reciprocating the head member.

16. Apparatus as defined in claim 15 further comprising clutch means for coupling said electric motor to said head member in response to a user command.

17. Apparatus as defined in claim 15 wherein said electric motor continuously reciprocates said head member.

18. Apparatus as defined in claim 10 further comprising first and second stop members for defining said first and second positions.

* * * * *